US005555697A

United States Patent [19]

Kim

[11] Patent Number: 5,555,697

[45] **Date of Patent: * Sep. 17, 1996**

[54] METHOD FOR CONNECTING PRECAST CONCRETE UNITS

[76] Inventor: Sun J. Kim, Imchang Apt. 3dong 508ho, Jungsan-dong 187-26, Eunpyung-ku, Seoul, Rep. of Korea

[ * ] Notice: The term of this patent shall not extend beyond the expiration date of Pat. No. 5,367,854.

[21] Appl. No.: 372,003

[22] Filed: Jan. 12, 1995

[30] Foreign Application Priority Data

Jan. 12, 1994 [KR] Rep. of Korea ..... 94-422

[51] Int. Cl.[6] ..... E04C 3/34

[52] U.S. Cl. ..... 52/741.1; 52/745.13; 52/745.18; 52/747.12; 52/259

[58] Field of Search ..... 52/745.13, 259, 52/741.1, 745.18, 745.21, 744, 743, 251, 252, 253, 258, 747.12; 264/27

[56] References Cited

U.S. PATENT DOCUMENTS

| | | | |
|---|---|---|---|
| 3,645,056 | 2/1972 | Gerola | 52/259 |
| 3,867,805 | 2/1975 | Mikami et al. | 52/744 |
| 3,881,289 | 5/1975 | Mauroner | 52/259 |
| 3,948,008 | 4/1976 | Goetz | 52/73 |
| 4,019,293 | 4/1977 | Armas | 52/79 |
| 5,367,854 | 11/1994 | Kim | 52/745.13 |

*Primary Examiner*—Carl D. Friedman
*Assistant Examiner*—Christopher Todd Kent
*Attorney, Agent, or Firm*—Burns, Doane, Swecker & Mathis, L.L.P.

[57] ABSTRACT

Method for connecting precast concrete units which do not have projecting reinforcing bars by heating the concrete placed into the connecting point electrically in order to shorten the curing period.

This method comprises the steps of covering the end surfaces of the precast concrete units with sheet-type wire nettings which have the same shape and size as that of the cross section of the precast concrete units, fixing the wire nettings in their position with nonconductive spacers, connecting the wire nettings to the terminals of an electric power source in order to heat the concrete as it becomes an electric resistant material and shorten the curing period.

1 Claim, 5 Drawing Sheets

METHOD FOR CONNECTING PRECAST CONCRETE UNITS

BACKGROUND OF THE INVENTION

1. Field of the Invention

The present invention relates in general to a method for connecting precast concrete units during construction work, for example connecting bridge girders, and more particularly to a wet connection method connecting precast concrete units to each other in which concrete placed in the connecting point between the units is electrically heated, thereby shortening the curing period and the length of time necessary to accomplish the work.

2. Description of the Prior Art

In U.S. Pat. No. 5,367,854, granted on Nov. 29, 1994, this inventor suggested a method for connecting precast concrete units, in which the projecting reinforcing bars from both units are connected with wire nettings placed in the space created by the projecting reinforcing bars to provide electrically conductive members.

This method can be used for precast concrete units which have projecting reinforcing bars, but concrete units without projecting reinforcing bars cannot be connected by this method.

In this respect, there is a need for a connecting method for precast concrete units which do not have projecting reinforcing bars, by which concrete placed in the connection parts can be electrically heated and so the curing period can be shortened.

SUMMARY OF THE INVENTION

It is one object of the present invention to provide a method for connecting precast concrete units without projecting reinforcing bars, in which concrete placed in the connecting point is electrically heated in order to shorten the curing period.

In an embodiment of the present invention, the object can be accomplished by using two sheet-type wire nettings which have the same shape and size as that of the cross section of the precast concrete units. The nettings can cover the end surfaces of the precast concrete units to be connected. Each wire netting is positioned to be in contact with the end surface of each precast concrete unit. Non-conductive spacers are applied between the two wire nettings in order to fix them in their positions and maintain a uniform interval.

Then, one wire netting is electrically connected to an electric power source termial, while the other wire netting is electrically connected to the other terminal of the same electric power source.

The connecting point is then surrounded with a form and concrete is poured into the form.

Thereafter, electricity is applied to the wire nettings, and the concrete between the two wire nettings is heated as it becomes an electric resistant material.

DETAILED DESCRIPTION OF THE PREFERRED EMBODIMENTS

Firstly referring to FIG. 1, FIG. 2 and FIGS. 6A–6D, the sheet-type wire nettings 2 should be made to have the same shape and size as that of the cross section 10 of the precast concrete units 1 to be connected.

Figure 1:
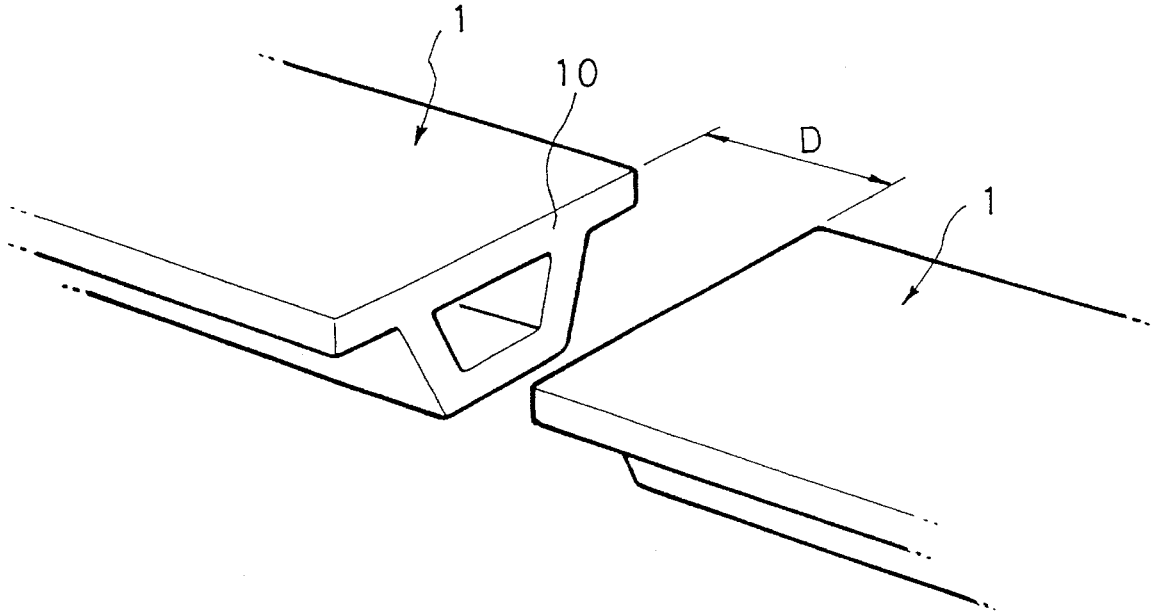
FIG. 1 is a perspective view showing the precast concrete units to be connected.
Figure 2:
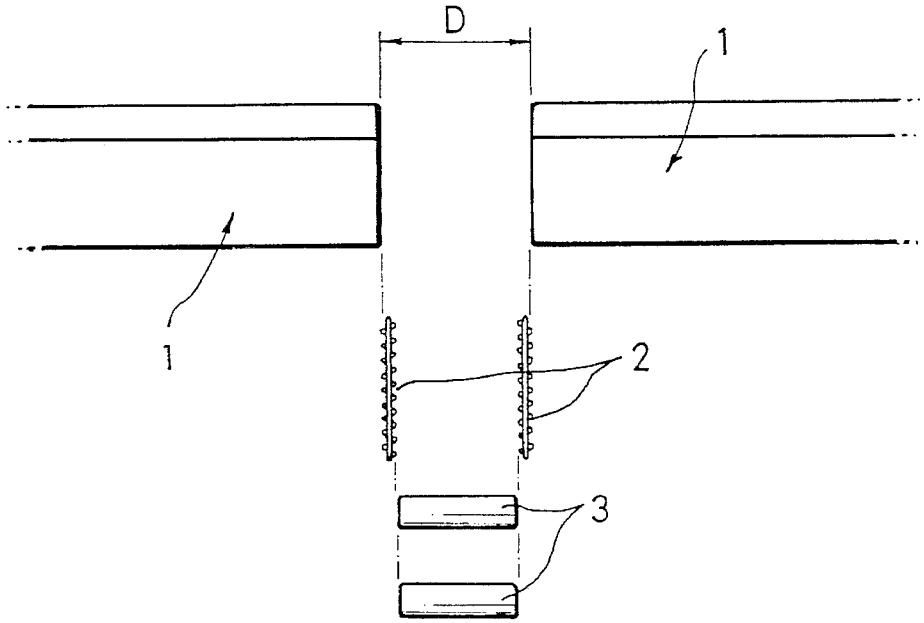
FIG. 2 is an exploded schematic view showing the wire nettings and nonconductive spacers prior to being placed into the connecting point between the precast concrete units.
Figure 6A:
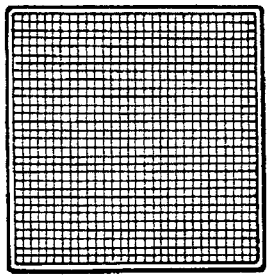
FIGS. 6A–6D show sheet-type wire nettings for four types of cross sections of precast concrete units.
Figure 6B:
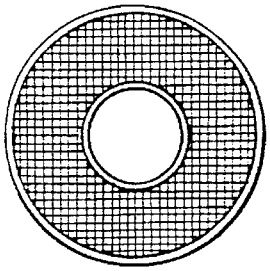
Figure 6C:
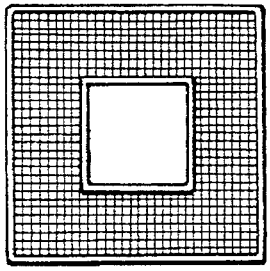
Figure 6D:
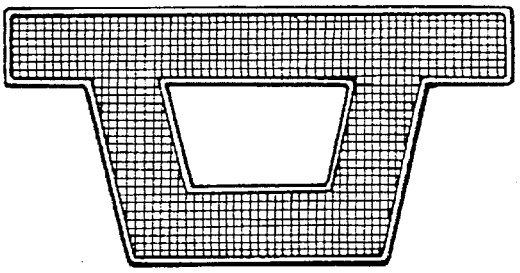

For example, when the bridge box girder units 1 shown in FIG. 1 are to be connected, the wire nettings should be made to have the shape as shown in FIG. 6D.

The "wire netting" means a conductive object such as the woven steel net, steel wire mesh or expanded metal, that has openings through which fresh concrete can easily pass.

Two wire nettings 2 are positioned and fixed to cover the end surfaces of the precast concrete units. These are positioned opposite of each other in order to construct a pair of electrodes.

Figure 3:
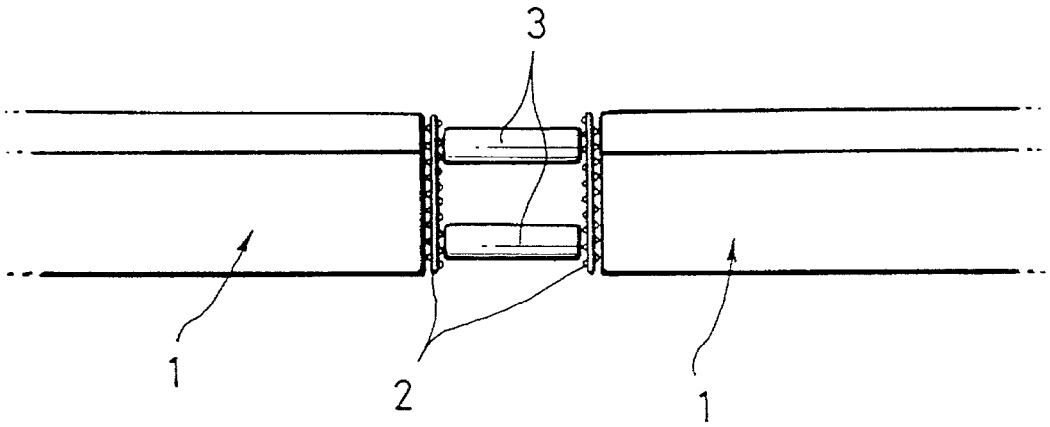
FIG. 3 is a schematic view showing the wire nettings and nonconductive spacers placed into the connecting point between the precast concrete units.

Nonconductive spacers 3 are applied between the wire nettings 2, so that a uniform interval is maintained as shown in FIG. 3. Nonconductive spacers 3 can have various shapes as shown in FIGS. 5A–5D, but their functions are all the same.- That is to fix the wire nettings 2 to their positions and maintain a uniform interval between the wire nettings 2.

One wire netting is electrically connected to a terminal of an electric power source 4, while the other wire netting is electrically connected to the other terminal of the same electric power source 4.

A temperature sensor 7 is positioned at between the wire netting in the connecting point.

The temperature sensor 7 is electrically connected to a controller 8 which is to control the electric current of power source 4.

Figure 4:
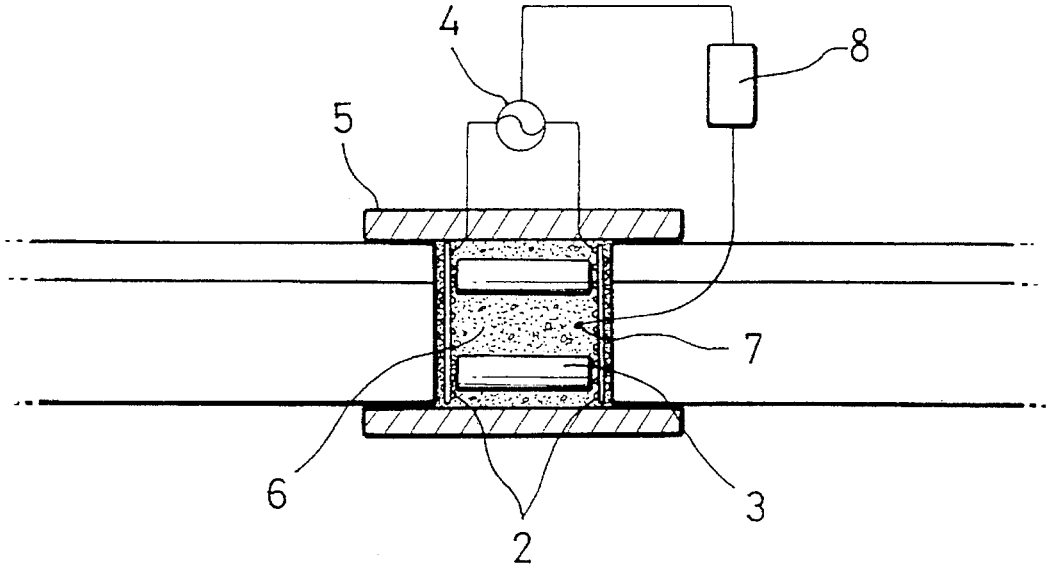
FIG. 4 is a schematic view showing the concrete placed into the connecting point being heated as it becomes an electric resistant material.
Figure 5A:
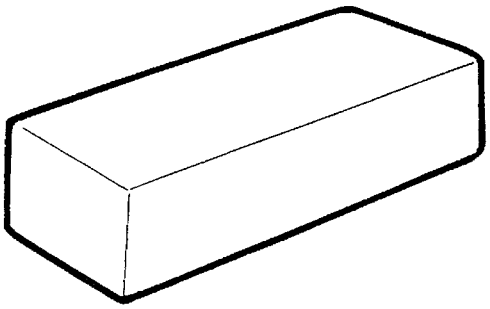
FIGS 5A–5D show perspective views of four types of nonconductive spacers.
Figure 5B:
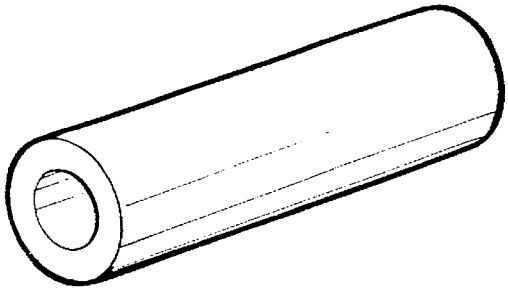
Figure 5C:
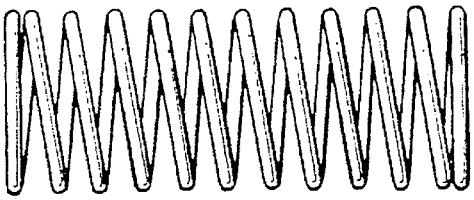
Figure 5D:
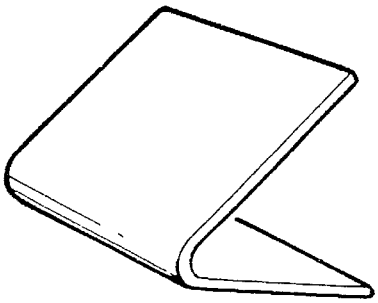

The connecting point is surrounded with a form 5 and concrete 6 is placed into the form 5 as shown in FIG. 4.

An electric power source 4 is applied to the wire nettings 2, and the concrete 6 between the wire nettings 2 is heated as it becomes an electric resistant material.

The temperature of the concrete 6 is measured by the sensor 7 and electric current is controlled by the controller 8 so that the temperature of the concrete 6 is controlled.

Figure 7:
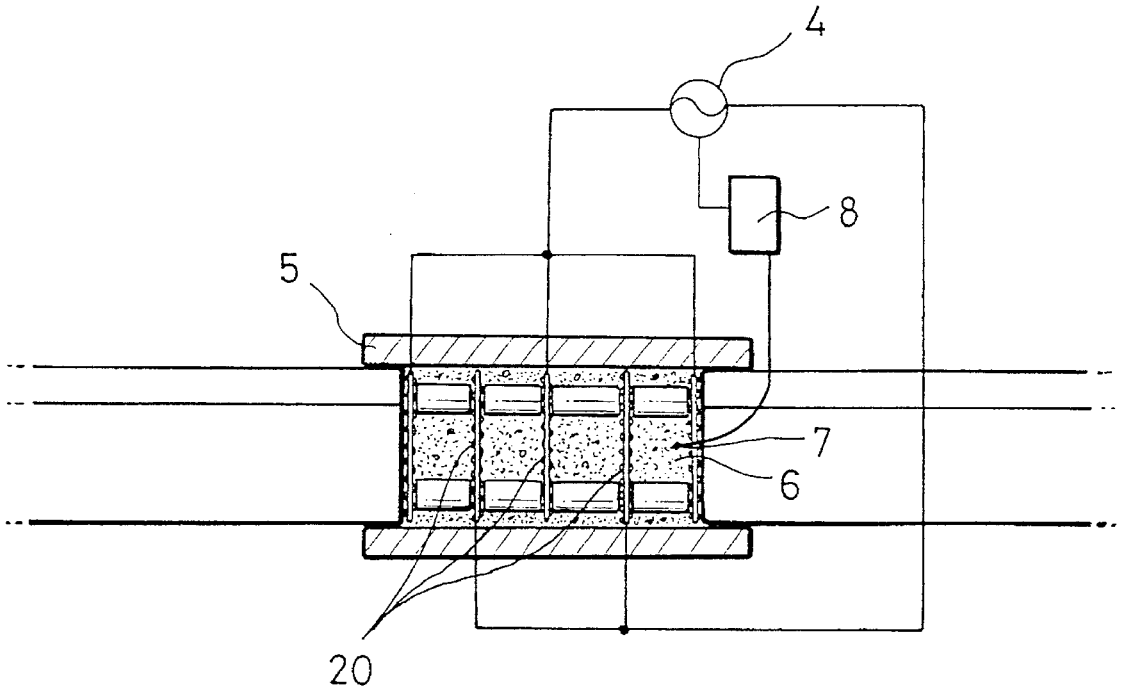
FIG. 7 is a schematic view corresponding to FIG. 4 but showing three additional wire nettings.

When the interval D between the two wire nettings 2 is so large that too high voltage is needed, additional wire nettings 20 are positioned between the two wire nettings 2 with uniform intervals by means of the nonconductive spacers 3 as shown in FIG. 7.

The additional wire nettings 20 are electrically connected to the terminals of electric power source 4 by turns, so that all the wire nettings 2 and 20 are connected to a terminal other than the terminal connected to the neighboring wire netting as shown in FIG. 7.

By this use of additional wire nettings, the concrete 6 in the connecting point can be heated uniformly with sufficient low voltage which creates no safety problems.

EMBODIMENT 1 a) First Step

Wire nettings 2 are made so as to have the same shape and size as size as that of the cross section of the precast concrete units as shown in FIGS. 1 and 6.

b) Second Step

Two wire nettings 2 are positioned to cover the end surfaces of the precast concrete units 1 and nonconductive spacers 3 are applied to fix the wire nettings 2 in their own positions as shown in FIG. 3.

c) Third Step

The wire nettings 2 are electrically connected to the terminals of an electric power source 4.

d) Fourth Step

A temperature sensor 7 is positioned at the connecting point, and the connecting point is surrounded by a form 5.

e) Fifth Step

Concrete 6 is poured into the form 5 as shown in FIG. 4. An electric power source 4 is applied and controlled.

EMBODIMENT 2 a) First Step

Wire nettings 2 and additional wire nettings 20 are made so as to have the same shape and size as that of the cross section of the precast concrete units 1.

b) Second Step

Two wire nettings 2 are positioned to cover the end surfaces of the precast concrete units, and additional wire nettings 20 are positioned between the wire nettings 2. Nonconductive spacers 3 are applied to fix the wire nettings with uniform intervals as shown in FIG. 7.

c) Third Step

All the wire nettings 2 and 20 are connected to the terminals of an electric power source 4 as shown in FIG. 7.

d) Fourth Step

A temperature sensor 7 is positioned at the connecting point, and the connecting point is surrounded by a form 5.

e) Fifth Step

Concrete 6 is poured into the form 5 as shown in FIG. 7. An electric current from the electric power source 4 is applied and controlled.

What is claimed is:

1. A method for connecting a pair of precast concrete units to each other to form a connecting point between the units comprising the steps of:

a) providing sheet-type wire nettings which have the same shape and size as that of the cross section of the precast concrete units;

b) positioning the wire nettings to cover the end surfaces of each of the pair of precast concrete units, and placing nonconductive spacers between the wire nettings to hold the wire nettings in their positions;

c) electrically connecting the wire nettings to the terminals of an electric power source;

d) positioning a temperature sensor between the wire nettings in the connecting point, and installing a form around the connecting point; and e) pouring concrete into the form, and applying an electric current from the power source to heat the concrete.

* * * * *